United States Patent [19]

Boon et al.

[11] 4,363,873

[45] Dec. 14, 1982

[54] PHOTOGRAPHIC CONTRAST ENHANCERS

[75] Inventors: John R. Boon, Woodbury; Gregory J. Wagner, St. Paul, both of Minn.

[73] Assignee: Minnesota Mining and Manufacturing Company, St. Paul, Minn.

[21] Appl. No.: 301,980

[22] Filed: Sep. 14, 1981

[51] Int. Cl.[3] ..... G03C 1/40

[52] U.S. Cl. ..... 430/546; 430/554; 430/555

[58] Field of Search ..... 430/546, 554, 555

[56] References Cited

U.S. PATENT DOCUMENTS

| | | | |
|---|---|---|---|
| 2,955,038 | 10/1960 | Smith | 430/602 |
| 3,043,697 | 7/1962 | Forsgard | 430/607 |
| 3,930,866 | 1/1976 | Oishi et al. | 430/554 |
| 4,207,393 | 6/1980 | Snyder | 430/554 |

*Primary Examiner*—J. Travis Brown

*Attorney, Agent, or Firm*—Cruzan Alexander; Donald M. Sell; Mark A. Litman

[57] ABSTRACT

As silver is the most expensive individual component in photographic film, it is desirable to reduce the quantities of silver in such materials. The addition of a certain class of phenolic derivatives has been found to enhance the contrast generated by dyes in color photographic emulsions. Emulsions containing these phenolic compounds can use less silver and produce the same optical density as emulsions with higher silver concentrations.

5 Claims, No Drawings

PHOTOGRAPHIC CONTRAST ENHANCERS

FIELD OF THE INVENTION

The present invention relates to the field of color photographic emulsions. Particularly, the present invention relates to the use of contrast enhancers in color photographic emulsion layers. These enhancers are found to increase the average and shoulder contrast of color forming couplers in color photographic emulsions. Certain ballasted enhancers are particularly useful in silver halide emulsions having oil dispersed couplers.

BACKGROUND OF THE INVENTION

The density of the image in a color photographic emulsion layer is the result of the amount of color photographic coupler which has reacted or coupled with oxidized photographic developer to form a dye. Given a class of color couplers, the conventional way of increasing the dye density for a fixed amount of light exposure has been to increase the amount of photographic silver halide or coupler or by increasing the amount of silver halide in the layer per unit of surface area, or to reduce the size of the silver halide grains or combinations of these techniques. By increasing the amount of silver halide or coupler in an emulsion layer, however, the cost of that emulsion layer is also increased significantly.

U.S. Pat. No. 4,207,393 found that certain phenolic materials were useful in the enhancement of contrast for silver halide photographic emulsions. These materials were particularly effective in photographic layers containing magenta couplers.

It has been found in the practice of the present invention that the addition of a certain class of phenolic compounds, different from those disclosed in U.S. Pat. No. 4,207,393, to a color photographic emulsion layer changes the shape of the conventional D (optical density) vs log E (energy of exposure) curve so as to desirably change the contrast of the emulsion. The effect of these phenolic compounds is to increase the density of the dye image formed at a given exposure level without necessarily changing the ratio of silver to coupler. In fact, one can maintain a given image dye density at a fixed exposure with reduced amounts of silver halide in the presence of enhancers of the present invention. In addition, the effect of these compounds is apparently somewhat different than that of increasing the amount of coupler or silver, in that the portion of the D-log E curve affected by these compounds is different than for changes affected by altering the silver to coupler ratio. The use of these compounds affects the upper portion or the shoulder of the D-log E curve as well as the curve shape. These enhancers are particularly useful with magenta couplers of the 1-phenyl-3-anilino-5-pyrazolone class.

DESCRIPTION OF THE INVENTION

It has been found in the practice of the present invention that certain phenolic compounds may be added to unexposed, undeveloped color photographic emulsions and that these compounds will enhance the contrast of the emulsion. These compounds may be represented by the formula:

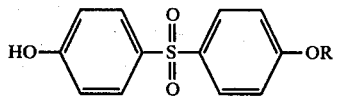

wherein R is alkyl of 4 to 20 carbon atoms, preferably 6–20 carbon atoms and most preferably 8 to 18 carbon atoms.

These phenolic compounds have been found to be particularly useful in the contrast enhancement of oil dispersed magenta couplers of the 1-phenyl-3-anilino-5-pyrazolone class. These couplers may be described by the general formula:

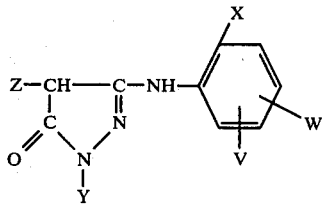

wherein

Y is an aryl group, preferably a phenyl group, and most preferably a halogen substituted phenyl group such as 2,4,6-trichlorophenyl, Z is a leaving or splitting-off group which is releasable from its attached position (the coupling position) when the coupler couples with an oxidized aromatic primary amine color developing agent, W represents a hydrophobic ballasting group, X represents a group selected from the class consisting of alkyl group, aryl group, alkoxy group, aryloxy group, N-substituted amino group, amido group, halogen atom, hydroxyl group, cyano group, or nitro group, and V represents a group selected from hydrogen or a group as defined for X or W.

These couplers are well known in the art, as for example in U.S. Pat. No. 3,930,866. Particularly desirable oil dispersed couplers are those wherein W represents a ballasting group of the formula:

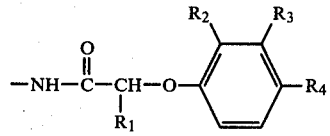

wherein $R_1$ is selected from the class consisting of hydrogen, and alkyl of from 1 to 20 carbon atoms, $R_2$ and $R_4$ are selected from the class consisting of hydrogen and alkyl, alkylene, or alkoxy of from 3 to 18 carbon atoms, $R_3$ is selected from the class consisting of hydrogen and alkyl or alkoxy of from 8 to 30 carbon atoms, with the limitations that when $R_3$ is hydrogen, the sum of the carbon atoms in $R_2$ and $R_4$ is at least 8 and no more than 30, and that when $R_3$ is alkyl or alkoxy, both $R_2$ and $R_4$ are hydrogen, or W has the formula:

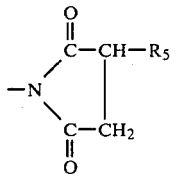

wherein $R_5$ is an alkyl or alkoxy group of from 8 to 30 carbon atoms.

Another desirable ballasting group includes

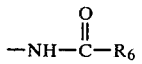

where $R_6$ is an alkyl group of from 8 to 20 carbon atoms.

The enhancers of the present invention may be introduced into the photographic emulsions in a number of ways. The most preferred way is to have the enhancers in the dispersed oil droplets. Another desirable means of introducing the enhancer is to have it within the emulsion, but outside of the droplet. It is believed that the enhancer may penetrate the droplet when this is done, but in any case, the contrast is enhanced when the phenolic compounds of the present invention are so introduced into the emulsion. A less desirable way of introducing the enhancers into the emulsion is by adding them to the developer solution. The enhancers of the present invention may be present in any effective amount. The preferred amount is approximately an equimolar ratio of the enhancer and pyrazolone coupler. A generally useful range for the molar ratio of enhancers to coupler in the emulsion would be between 0.05/1 and 2.0/1. A more preferred ratio range would be between 0.4/1 and 1.5/1. When the enhancers are present in the developer solution, a weight ratio range of enhancer/developer of between 0.05/1 to 1.8/1 is preferred, and a ratio of between 0.10/1 and 1.0/1 is more preferred.

The action of the enhancers of the present invention is believed to be independent of the halogen nature of the silver halide emulsion. The silver halide may be silver chloride, silver bromide, silver chlorobromide, silver iodobromide, silver iodochlorobromide, or other combinations of iodide, chloride and bromide as the halide. The action of the enhancers of the present invention is also believed to be independent of the nature of the primary aromatic amine photographic developer. The p-phenylene diamine class of developers is most preferred.

Conventional photographic additives may also be used with the enhancers of the present invention. These materials include surfactants, antifoggants, stabilizers, sensitizing dyes, acutance dyes, hardeners, etc.

U.S. Pat. Nos. 2,955,038 and 3,043,697 disclose the use of di-ortho and di-meta bisphenolic compounds having some similarity in structure to the enhancer of the present invention. These compounds are shown as antifoggants in silver halide emulsions. Only black and white emulsions are shown and no oil dispersions are shown therein.

U.S. Pat. Nos. 3,408,294 and 3,655,598 show the use of the group

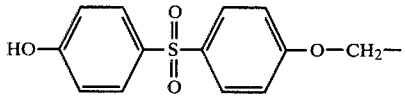

as a leaving group on color photographic couplers. When this group is split off the coupler, it would be one of the enhancers of the present invention. However, these compounds are not present in unexposed, undeveloped emulsions. An unexposed emulsion, according to the practice of the present invention, is an emulsion which has not been sensitized to development by exposure to light and which when developed would show only spurious images, i.e., fog and dye stain. Any emulsion which when developed according to the complete procedures of Example 1 and shows a D min in excess of 0.25 is an exposed emulsion. A developed emulsion in the practice of the present invention is one in which oxidized photographic color developer, particularly of the primary aromatic amine type, or its coupled product with color photographic couplers, particularly of the 1-phenyl-3-anilino-5 pyrazolone type, is present in the emulsion.

The present invention relates to constructions having these enhancers present in unexposed and undeveloped color photographic emulsions having oil dispersed color photographic couplers of the 1-phenyl-3-anilino-5-pyrazolone type therein.

These and other aspects of the present invention will be shown in the following examples.

In the examples, the following formulae will be repeatedly referred to:

Enhancer Formula

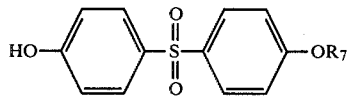

Coupler 1

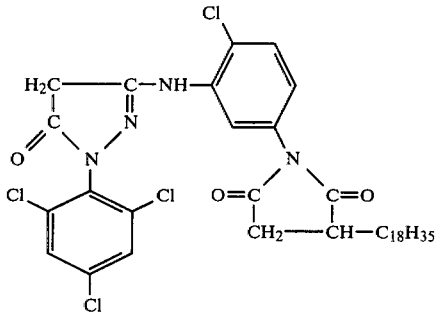

EXAMPLES 1-3

6.85 grams of coupler 1 and 3.1 grams of enhancer No. 4 from U.S. Pat. No. 4,207,393 were dissolved with stabilizers and antioxidants in 2.6 ml of di-n-butylphthalate, 2.6 ml of tricresylphosphate and 23 ml of ethyl acetate. This solution was then added to 105 g of an aqueous solution containing 4.3 g of gelatin and 1 cc of Tergitol 4 (28% solution of sodium sulfate derivative of 7-ethyl-2-methyl-4-undecanol) and homogenized to prepare a coupler dispersion. The coupler dispersion was then mixed with 251 grams of a gelatin silver chlorobromide emulsion (Br:85 mol % containing 4 g of silver) which had been spectrally sensitized to green light with a cyanine dye. After adding a gelatin hardener and coating aids, this mixture was coated on a paper support, both sides of which were laminated with polyethylene, in a standard tripack formulation with red, green and blue sensitive layers. The coating thus obtained contained 595 mg/m$^2$ of magenta coupler in the green sensitive layer.

Identical dispersions having equimolar proportions of contrast enhancers of the present invention according to the above structural Enhancer Formula where $R_7$ was $(CH_2)_7CH_3$ in Enhancer C and was $(CH_2)_{15}CH_3$ in Enhancer E were prepared and coated in the above construction to make a comparison with the best enhancer of U.S. Pat. No. 4,207,393. These samples were exposed for 0.1 sec. with light from a 2950° K. tungsten lamp giving 1700 MC illuminance at the filter plane through a 20 cm continuous type M carbon wedge (gradient: 0.20 density/cm), a Wratten 2C ultraviolet absorbing filter and a Wratten #58 green filter. After exposure, these samples were processed in the following solutions:

| Developer Solution | |
|---|---|
| Ethylene glycol | 21.3 ml |
| Benzyl alcohol | 15.1 ml |
| Potassium carbonate (anhydrous) | 32 gm |
| Potassium sulfite (anhydrous) | 2.1 gm |
| Potassium bromide | 0.6 gm |
| Hydroxylamine sulfate | 3.86 gm |
| Nitrilo-tris-methylene phosphonic acid | 0.6 gm |
| 4,4'bis[2-methoxy-4-(di(2-hydroxyethyl) amino)-5-triazinylamino]stilbene-2,2'-disulfonic acid disodium salt | 1.0 gm |
| Lithium sulfate | 1.78 gm |
| Potassium Chloride | 0.25 gm |
| N[2-[N—ethyl-N—(4-amino-3-methylphenyl) amino]-ethyl]methanesulfonamide sesquisulfate (monohydrate) | 4.85 gm |
| Potassium hydroxide (45% solution) | 1.1 ml |
| Water to make | 1000 ml |
| (pH 10.1) | |

| Bleach-Fix Solution | |
|---|---|
| Ferric Ammonium EDTA (1.56 Molar solution) | 106 ml |
| Ammonium thiosulfate (58% solution) | 120 ml |
| Sodium bisulfite | 13 gm |
| Ammonium hydroxide (28% ammonia solution) | 30 gm |
| EDTA (Ethylene diamine tetraacetate acid) | 35 gm |
| Water to make | 1000 ml |
| (pH 8.8) | |

| Processing Step | Temp (C.) | Time |
|---|---|---|
| Developer | 33 | 4 mn 30 sec |
| Bleach-Fix | 33 | 1 mn 30 sec |
| Wash | 30–36 | 3 mn |
| Dry | 20–90 | 30 sec to 5 mn |

After processing, status D densitometry was measured. The results obtained are shown in Table I.

TABLE I

| Example | Magenta Dmax | Magenta Contrast | Enhancer |
|---|---|---|---|
| 1 | 2.59 | 2.25 | 4 (of U.S. 4,207,393) |
| 2 | 2.69 | 2.65 | C |
| 3 | 2.72 | 2.77 | E |

The enhanced contrast provided by the materials of the present invention can be readily seen.

EXAMPLES 4–10

The above coating was identically reproduced except that the following contrast enhancers were used in equimolar proportions to enhancer A which was present as 2.47 grams.

(A) $R_7=CH_3$
(B) $R_7=(CH_2)_3CH_3$
(C) $R_7=(CH_2)_7CH_3$
(D) $R_7=(CH_2)_{13}CH_3$
(E) $R_7=(CH_2)_{15}CH_3$
(F) $R_7=CH_2C_6H_5$

The enhancer F is also included within the teaching of U.S. Pat. No. 4,207,393 as compound number 4. These coatings were exposed and developed as in Examples 1–3 and the data is shown below in Table II. No enhancer was used in Example 10.

TABLE II

| Example | Magenta Dmax | Magenta Contrast | Enhancer |
|---|---|---|---|
| 4 | 2.39 | 2.00 | A |
| 5 | 2.45 | 2.32 | B |
| 6 | 2.58 | 2.95 | C |
| 7 | 2.59 | 2.98 | D |
| 8 | 2.61 | 3.03 | E |
| 9 | 2.42 | 2.34 | F |
| 10 | 2.48 | 2.07 | None |

The enhanced contrast provided by the materials of the present invention can be readily seen from the above data.

We claim:

1. A color photographic silver halide emulsion in a layer comprising a hydrophilic colloid, silver halide, and an oil droplet dispersion of a anilino-5-pyrazolone color photographic coupler, wherein said layer also contains an effective amount of a contrast enhancer of the formula:

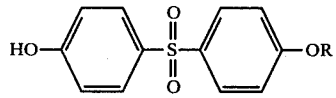

wherein R is an alkyl group of 4 to 20 carbon atoms.

2. The emulsion of claim 1 wherein R is an alkyl group of 6–20 carbon atoms.

3. The emulsion of claim 1 wherein R is an alkyl group of 8 to 20 carbon atoms.

4. The emulsion of claims 1, 2 or 3 wherein said contrast enhancer is present in an amount which provides a ratio of enhancer/color coupler of between 0.4/1 and 1.5/1.

5. The emulsion of claims 1, 2 or 3 wherein said pyrazolone color coupler has the formula:

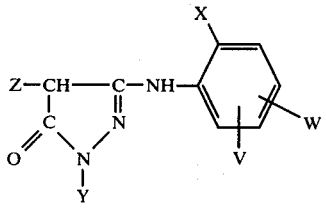

wherein

Y is a halogen substituted phenyl ring,

Z is a splitting-off group which is released from its attached position when the coupler couples with an oxidized aromatic primary amine color developing agent, W is a hydrophobic ballasting group, X represents a group selected from the class consisting of alkyl group, aryl group, alkoxy group, aryloxy group, N-substituted amino group, amido group, halogen atom, hydroxyl group, cyano group or nitro group, and V represents hydrogen, or a group as defined for X or W.

* * * * *